US006096142A

United States Patent [19]

Kano et al.

[11] Patent Number: 6,096,142

[45] Date of Patent: Aug. 1, 2000

[54] HIGH TEMPERATURE ABRASION RESISTANT COPPER ALLOY

[75] Inventors: Makoto Kano, Yokohama; Mamoru Sayashi, Miura, both of Japan

[73] Assignee: Nissan Motor Co., Ltd., Yokohama, Japan

[21] Appl. No.: 08/929,888

[22] Filed: Sep. 15, 1997

Related U.S. Application Data

[63] Continuation of application No. 08/501,471, Jul. 12, 1995, abandoned.

[30] Foreign Application Priority Data

Jul. 20, 1994 [JP] Japan ..... 6-168297

[51] Int. Cl.[7] ..... C22C 9/01

[52] U.S. Cl. ..... 148/436; 148/435; 428/416

[58] Field of Search ..... 148/679–687, 148/436, 435; 75/300, 328, 329; 428/416; 420/486, 489

[56] References Cited

U.S. PATENT DOCUMENTS

| | | | |
|---|---|---|---|
| 4,915,903 | 4/1990 | Brupbacher et al. | 420/129 |
| 5,069,874 | 12/1991 | Shirosaki et al. | 420/478 |
| 5,468,310 | 11/1995 | Fujiki et al. | 148/435 |

FOREIGN PATENT DOCUMENTS

| | | |
|---|---|---|
| 62-013549 | 1/1987 | Japan . |
| 2-107729 | 4/1990 | Japan . |
| 2-179839 | 7/1990 | Japan . |
| 3-291341 | 12/1991 | Japan . |
| 5-214467 | 8/1993 | Japan . |

*Primary Examiner*—Sikyin Ip
*Attorney, Agent, or Firm*—Foley & Lardner

[57] ABSTRACT

A high temperature abrasion resistant copper alloy suitable for the material of an engine parts such as valve seats and valve guides. The copper alloy comprises aluminum in an amount ranging from 1.0 to 5.0% by weight; at least one selected from vanadium, niobium and tantalum in the group Va of the periodic table of elements, in an amount ranging from 0.1 to 5.0% by weight; and balance including copper and impurities. The copper alloy has a texture in which at least one kind of intermetallic compounds is dispersed, each intermetallic compound kind containing aluminum, at least one selected from elements of the group Va of the periodic table, and silicon.

3 Claims, 1 Drawing Sheet

25μm

25μm

HIGH TEMPERATURE ABRASION RESISTANT COPPER ALLOY

This application is a continuation of application Ser. No. 08/501,471, filed Jul. 12, 1995, now abandoned.

BACKGROUND OF THE INVENTION

1. Field of the Invention

This invention relates to improvements in a copper alloy, and more particularly to a copper alloy high in oxidation resistance and abrasion resistance at high temperatures and suitable for the material of frictionally sliding members of an engine such as a valve seat (or valve insert) and a valve guide for supporting a valve stem.

2. Description of the Prior Art

In recent years, automotive engines have been increasing in performance and power output, and therefore there has been a tendency that valve seats and valve guides are subjected to higher temperature and higher sliding bearing stress than conventional ones. Additionally, the valve seats and the valve guides have been required to have a better heat transmission in order to obtain both high power output and good fuel economy. Thus, high abrasion resistance and high coefficient of thermal conductivity have been required for the materials of the automotive engine parts such as the valve seats and the valve guides.

Research and development of such materials have been hitherto made around copper alloys. In this connection, the materials AlBC 1 to 4 (particularly AlBC 3) and similar AISI C95500 have been into practical use for valve seats or the likes. These materials are prepared by adding Ni and Fe to aluminum bronze. AlBC 1 to 4 are according to JIS (Japanese Industrial Standard) and discussed in a technical book "Non-Ferrous Metal", page 73, 14th edition, published in 1978 and written by Masataka Sugiyama and published by Korona-sha. AISI C95500 is discussed in "Metals Handbook 9th Edition Vol. 2", page 433, published in 1979 by American Society for Metals.

However, these conventional copper alloy are not sufficient particularly in abrasion resistance at high temperatures in case that they are used as the valve seat and the valve guide of an automotive engine which are subjected to severe conditions required to obtain the high performance and high power output of the engine. In other words, there is the possibility that the engine parts of the conventional copper alloys become large in abrasion amount under such severe conditions, and therefore the copper alloy are not suitable for the engine parts.

SUMMARY OF THE INVENTION

It is an object of the present invention to provide an improved copper alloy which can overcome drawbacks encountered in conventional copper alloys. Another object of the present invention is to provide an improved copper alloy which is excellent in abrasion resistance at high temperatures and suitable for the material of parts of an engine which parts are subjected to severe friction at high temperatures, for example, valve and valve guides.

A further object of the present invention is to provide an improved copper alloy which is high in hardness of the matrix and has a texture including a large amount of bulky intermetallic compounds precipitated in a dispersed state thereby improving a softening resistance of the copper alloy at high temperatures while being improved in abrasive wear due to biting deposit or the like between frictional members.

A high temperature abrasion resistant copper alloy of the present invention comprises aluminum in an amount ranging from 1.0 to 5.0% by weight; at least one selected from the group consisting of vanadium, niobium and tantalum in the group Va of the periodic table of elements, in an amount ranging from 0.1 to 5.0% by weight; silicon ranging from 1.0 to 5.0% by weight; and balance including copper and impurities; wherein the copper alloy has a texture in which at least one kind of intermetallic compounds is dispersed, each kind of intermetallic compounds containing aluminum, at least one selected from the group consisting of elements in the group Va of the periodic table, and silicon.

In the copper alloy of the present invention, at least one kind of intermetallic compounds each containing Al, at least one of the group Va elements and Si is precipitated as hard precipitate having a grain size not smaller than 5 $\mu$m and dispersed in a volume percentage of not less than 10% in a texture formed after, for example, padding or cladding under a laser. As a result, the copper alloy is high in lowering suppressing effect of hardness at high temperatures (for example, 500° C.) thereby effectively improving the abrasion resistance at high temperatures, while being greatly improved in resistance to abrasive wear under the action of deposit or the like, for example, brought into contact with an intake valve seat. Additionally, in this copper alloy, Si serves, for example, as a deoxidizer during the padding or cladding by the laser and therefore improves the productivity of products which are excellent in abrasion resistance and suitable for the material of sliding members or parts of a variety of high performance internal combustion engines. Of these sliding members, excellent performances are obtained particularly on a valve seat to which a valve face is contactable and a valve guide slidable to a valve stem. In this regard, for example in case of using the copper alloy of the present invention as the material of the valve seat, the valve seat can have excellent abrasion resistance and abrasive wear resistance at high temperatures and therefore is suppressed in lowering of thermal conductivity. This allows an opposite valve (face) to be suppressed low in temperature rise. As a result, significant contribution is made to causing the engine to output a high power output and to improvement in anti-knocking characteristics of the engine. It will be appreciated that the copper alloy of the present invention is suitable for the material of a variety of sliding members or the like requiring a performance similar to the valve seat, while greatly contributing to improving a high temperature abrasion resistance of the sliding members or the like.

DETAILED DESCRIPTION OF THE INVENTION

Figure 1:
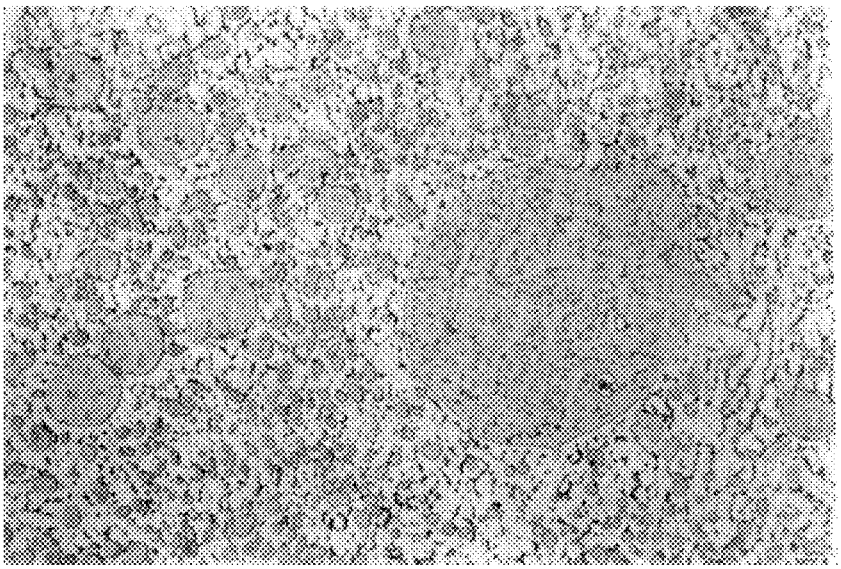
FIG. 1 is a microphotograph of the texture of the copper alloy of Example 8 of the present invention.

According to the present invention, a high temperature abrasion resistant copper (Cu) alloy comprises aluminum (Al) in an amount ranging from 1.0 to 5.0% by weight; at least one selected from the group consisting of vanadium (V), niobium (Nb) and tantalum (Ta) in the group Va of the periodic table of elements, in an amount ranging from 0.1 to 5.0% by weight; and balance including copper (Cu) and impurities; wherein the copper alloy has a texture in which at least one kind of intermetallic compounds is dispersed, each kind of intermetallic compounds containing aluminum, at least one selected from the group consisting of elements in the group Va of the periodic table, and silicon (Si). Optionally, the copper alloy comprises cobalt (Co) in an amount ranging from 5.0 to 20.0% by weight; at least one of iron (Fe) and nickel (Ni) in a total amount ranging from 5.0 to 20.0% by weight; and/or manganese (Mn) in an amount ranging from 1.0 to 10.0% by weight.

Hereinafter, discussion will be made on components of the copper alloy of the present invention.

Al:

Al in the copper alloy is contained in a matrix to form a solid solution thereby to increase strength and hardness of the copper alloy at high temperatures ranging from room temperature to 400° C. and improve an abrasion resistance of the copper alloy at high temperatures under improvement in oxidation resistance due to formation of $Al_2O_3$ film at high temperatures. Furthermore, Al combines with elements in the group Va of the periodic table, Si, Co, Fe (iron), Ni (nickel) and/or the like which are discussed after thus to crystallize composite intermetallic compounds thereby to improve heat resistance and abrasion resistance of the copper alloy. However, Al is low in melting point and therefore a high temperature hardness is excessively lowered if the content of Al exceeds 5.0% by weight. In view of this, the content of Al is determined within a range of from 1.0 to 5.0% by weight.

Si:

Si in the copper alloy serves as a deoxidizer for preventing the material of copper alloy from being embrittled owing to oxidation, for example, during padding or cladding by laser, and forms solid solution with the matrix. Additionally, Si combines with Cu, Al and/or element(s) of the group Va to form a variety of composite intermetallic compounds. This provides a texture of the copper alloy in which a large amount of hard precipitate exceeding 15% by volume of the copper alloy are uniformly distributed, each precipitate having a grain size not smaller than 5 $\mu$m. As a result, the copper alloy can be effectively suppressed in lowering of a high temperature hardness at 500° C. while being excellent in abrasive wear. The content of Si is determined within a range of from 1.0 to 5.0% by weight relative to the copper alloy because the above advantages cannot be sufficiently obtained if the content is less than 1.0% by weight whereas a thermal conductivity of the copper alloy is lowered if the content exceeds 5.0% by weight.

Co:

Co in the copper alloy is contained in the matrix to form a solid solution thereby increasing the heat resistance of the copper alloy. Co combines with Cu, Al and/or Si to form intermetallic compounds, while combines with the group Va element(s), Si, Cu and/or Al to form a variety of composite intermetallic compounds, thereby improving the heat resistance and abrasion resistance of the copper alloy. However, such advantageous effects cannot be sufficiently obtained if the content of Co is less than 5.0% by weight, whereas the thermal conductivity of the copper alloy exceeds 20.0% by weight. As a result, the content of Co is determined within a range of from 5.0 to 20.0% by weight relative to the copper alloy.

The group Va elements:

The group Va elements such as V, Nb, Ta and the like in the copper alloy combine with Al, Si and/or Co to form spherical or granular intermetallic compounds each having a grain size not smaller than 5 $\mu$m. This largely contributes to suppression of lowering in the high temperature hardness of the copper alloy at 500° C. and to improving the abrasive wear of the copper alloy. In case that the content of the Va group elements exceeds 15% by weight, at least one kind of intermetallic compounds including Cu and at least one of the Va group elements is formed in addition to the above intermetallic compound including Al and the Va group elements thereby further contributing to improving the abrasion resistance of the copper alloy. However, if the total content of the group Va elements is less than 0.1% by weight, the above advantageous effect cannot be sufficiently obtained. If the content exceeds 5.0% by weight, the group Va element(s) cannot be dissolved in the matrix and unavoidably segregates. As a result, the total content of the group Va elements is determined within a range from 0.1 to 5.0% by weight relative to the copper alloy.

Fe and Ni:

Fe and Ni in the copper alloy combine mainly with Al, Si and the group Va elements to form intermetallic compounds thereby improving the heat resistance and the abrasion resistance of the copper alloy. However, the above advantageous effects cannot be sufficiently obtained if the total content of Fe and Ni is less than 5.0% by weight, whereas the copper alloy is degraded in thermal conductivity and embrittled if the content exceeds 20.0% by weight. Accordingly, the total content of Fe and Ni is determined within a range of from 5.0 to 20.0% by weight relative to the copper alloy.

Mn:

Mn in the copper alloy functions to granulate the texture of the copper alloy thereby to increase a physical strength of the copper alloy, and prevents a slow cooling embrittlement of the copper alloy. Additionally, Mn is contained in the matrix forming a solid solution thereby increasing the physical strength and the abrasion resistance of the copper alloy. However, the above advantageous effects cannot be sufficiently obtained if the content of Mn is less than 1.0% by weight, whereas the thermal conductivity of the copper alloy is degraded if the content exceeds 10.0% by weight. Accordingly, the content of Mn is determined within a range of from 1.0 to 10.0% by weight relative to the copper alloy.

As appreciated from the above, the high temperature abrasion resistant copper alloy according to the present invention comprising: Al in an amount ranging from 1.0 to 5.0% by weight; at least one selected from the group consisting of V, Nb and Ta in the group Va of the periodic table of elements, in an amount ranging from 0.1 to 5.0% by weight; Si in an amount ranging from 1.0 to 5.0% by weight; and balance including copper and impurities. Optionally, the copper alloy comprises Co in an amount ranging from 5.0 to 20.0% by weight; at least one of Fe and Ni in a total amount ranging from 5.0 to 20.0% by weight; and/or Mn in an amount ranging from 1.0 to 10.0% by weight. Accordingly, the copper alloy of the present invention contains a variety of kinds of intermetallic compounds which are suitably dispersed in the copper alloy. Each kind of intermetallic compound contains at least one of Al and Cu, at least one of elements in the group Va of the periodic table and Si, optionally at least one of Co, Fe and Ni.

Examples of such kinds of intermetallic compounds are Al—V—Si, Cu—V—Si, Al—Nb—Si, Cu—Nb—Si, Al—Ta—Si, Cu—Ta—Si, Al—Cu—V—Si, Al—V—Co—Si, Cu—V—Co—Si, Al—Cu—Nb—Si, Al—Co—Nb—Si, Cu—Co—Nb—Si, Al—Cu—Ta—Si, Al—Co—Ta—Si, Cu—Co—Ta—Si, Al—V—Co—Fe—Si, Cu—V—Co—Fe—Si, Cu—Al—V—Nb—Co—Fe—Si and the like. Accordingly, the copper alloy of the present invention can be effectively suppressed in hardness lowering at 500° C. and recognized to be improved in resistance to abrasive wear due to deposit or the like. Additionally, since the copper alloy of the present invention contains Si, the characteristics of padding or cladding in atmospheric air (more specifically, in an Ar gas-shielded atmosphere) can be largely improved. As a result, the copper alloy of the present invention is suitable for not only for a valve seat but also other sliding members to be used at a high temperature condition, such as engine parts.

EXAMPLES AND COMPARATIVE EXAMPLES

The invention will be understood more readily with reference to the following examples and comparative examples; however, these examples are intended to illustrate the invention and are not to be construed to limit the scope of the invention.

First, alloy powders of Examples 1 to 10 and Comparative Examples 1 to 4 were prepared by the following process: Raw materials (metals) were molten in a graphite crucible by using a high frequency induction furnace to obtain a copper alloy molten metal having a composition shown in the column of Examples 1 to 10 and Comparative Examples 1 to 15 in Table 1. The copper alloy molten metal was powdered by gas atomization and then subjected to dehydration and particle size distribution control thereby preparing metal powder for padding or cladding. The thus obtained metal powder corresponds to each of Examples 1 to 10 and Comparative Examples 1 to 15. The metal powder was padded or clad in a thickness of not less than 3 mm on a groove which was formed by machining a valve seat (or valve insert) portion of an actual cylinder head formed of aluminum alloy (AC2A according to JIS), by using $CO_2$ gas laser generated from a laser device (not shown) having a capacity of 5 kW under padding conditions shown in Table 3.

Thereafter, machining was made on the thus formed padded or clad layer to finish so that the valve seat portion had predetermined dimensions, thus completing a padding or cladding treatment. As a result, the actual cylinder head provided with the valve seat portion padded with the copper alloy of Examples 1 to 10 and Comparative Examples 1 to 4 was prepared to be subjected to a durability test. The above-mentioned padding or cladding treatment was made for the valve seat portion of both intake and exhaust valves of an engine cylinder.

TABLE 1

| Item | Composition (wt %) | | | | | | |
|---|---|---|---|---|---|---|---|
| | Al Group Va elements | Si | Co | Fe | Ni | Mn | Cu + Impurities |
| Example | | | | | | | |
| 1 | 1.2 V: 0.3 | 1.1 | — | — | — | — | Balance |
| 2 | 4.9 V: 2.5 | 2.3 | — | — | — | — | Ditto |
| 3 | 1.7 V: 2.4 | 4.6 | — | — | — | — | Ditto |
| 4 | 3.0 V: 2.3, Nb: 2.4 | 4.8 | — | — | — | — | Ditto |
| 5 | 3.5 V: 2.0, Ta: 2.3 | 3.5 | 5.2 | — | — | — | Ditto |
| 6 | 4.3 Nb: 2.3, Ta: 2.0 | 4.2 | 14.3 | — | — | — | Ditto |
| 7 | 4.8 V: 2.4, Nb: 2.5 | 4.5 | 19.5 | 5.3 | — | — | Ditto |
| 8 | 1.3 V: 2.1, Nb: 1.8 | 3.2 | 13.7 | 4.4 | 15.3 | — | Ditto |
| 9 | 1.1 V: 1.9, Nb: 2.2 | 2.7 | 12.5 | 6.4 | 12.7 | 1.2 | Ditto |
| 10 | 4.5 V: 2.2, Nb: 2.5 | 4.7 | 14.8 | 5.7 | 14.1 | 9.7 | Ditto |
| Comparative Example | | | | | | | |
| 1 | 0.4 V: 1.3 | 1.4 | — | — | — | — | Ditto |
| 2 | 1.3 V: 0.03 | 1.8 | — | — | — | — | Ditto |
| 3 | 1.2 V: 2.1 | 0.3 | — | — | — | — | Ditto |
| 4 | 5.7 V: 1.8 | 3.3 | — | — | — | — | Ditto |

TABLE 2

| Item Comparative | Composition (wt %) | | | | | | |
|---|---|---|---|---|---|---|---|
| Example | Al Group Va elements | Si | Co | Fe | Ni | Mn | Cu + Impurities |
| 5 | 1.8 V: 3.1, Nb: 3.0 | 2.8 | — | — | — | — | Balance |
| 6 | 2.1 V: 2.2, Nb: 2.4 | 5.8 | — | — | — | — | Ditto |
| 7 | 2.2 V: 2.1, Nb: 2.0 | 2.7 | 4.1 | — | — | — | Ditto |
| 8 | 2.1 V: 1.9, Nb: 2.3 | 3.1 | 21.2 | — | — | — | Ditto |
| 9 | 1.6 V: 2.3, Nb: 1.9 | 2.9 | 14.7 | 3.9 | — | — | Ditto |
| 10 | 1.8 V: 2.3, Nb: 2.0 | 3.2 | 14.9 | 6.5 | 14.2 | — | Ditto |
| 11 | 1.5 V: 2.0, Nb: 2.1 | 3.2 | 14.7 | 5.6 | 13.8 | 0.4 | Ditto |
| 12 | 1.7 V: 2.0, Nb: 1.9 | 3.1 | 13.9 | 5.4 | 14.5 | 11.3 | Ditto |
| 13 | — V: 2.1, Nb: 2.2 | 3.2 | 13.5 | 6.3 | 13.9 | 1.6 | Ditto |
| 14 | 1.2 — | 3.3 | 13.1 | 6.0 | 12.8 | 1.1 | Ditto |
| 15 | 1.4 V: 1.9, Nb: 2.1 | — | 14.3 | 5.1 | 14.8 | — | Ditto |

TABLE 3

| Padding conditions | |
|---|---|
| Laser output | 4.5 kW |
| Machining speed | 0.8 m/min |
| Sealed gas atmosphere | Ar |
| Sealed gas flow rate | 20 l/min |

MATERIAL CONFIRMATION TEST

The above metal powder of each of Examples 1 to 10 and Comparative Examples 1 to 15 was padded or clad on a plate of an aluminum alloy (AC2A according to JIS) under the same conditions as those in preparation of the cylinder head for durability test. A test piece was cut out from the padded portion on the plate and subjected to a high temperature hardness measurement and an observation of microstructure by an optical microscope. Thereafter, a volume percentage of the intermetallic compounds precipitated in the test piece was measured on the microstructure of the test piece in the following manner: A percentage of the area of the precipitated intermetallic compounds was measured for each of five sectional surfaces of the test piece under an image analysis. Then, an average value of the obtained five area percentages was calculated. From this average value, a volume percentage of the intermetallic compounds precipitated in the copper alloy of the test piece was determined for each of Examples 1 to 10 and Comparative Examples 1 to 15. Additionally, in order to obtain kind of the intermetallic compounds, the main alloy components of the intermetallic compounds were determined from the result of a structure analysis upon an EPMA analysis by an electron microscope and a X-ray diffraction.

The results of the confirmation of the material or copper alloy of Examples 1 to 10 and Comparative Example 1 to 15 are shown together with a result of an actual engine test as set forth below, in Tables 5 to 7.

ACTUAL ENGINE TEST

Next, the engine cylinder head having the valve seat portion padded with the copper alloy of Examples 1 to 10 and Comparative Examples 1 to 15 was assembled in an actual engine and subjected to an actual engine durability test under actual engine test conditions shown in FIG. 4 to evaluate an abrasion durability of the engine, in which a temperature measurement test for the exhaust valve was conducted as follows: An elongate hole was formed axially in the exhaust valve to extend though the valve stem to the vicinity of the surface of a valve head. A thermocouple was inserted in the elongate hole to directly measure the temperature of a position directly under the valve head surface. After completion of this exhaust valve temperature measurement test, the exhaust valve formed with the elongate hole was replaced with a usual new exhaust valve, and then the durability test was continued. At this time, the state of abrasion of the padded valve seat portion was observed.

TABLE 4

| Actual engine test conditions | | |
|---|---|---|
| Item | Temperature measurement test for exhaust valve | Abration durability evaluation |
| Engine | 1998 cc, in-line four cylinders, DOHC | 1998 cc, in-line four cylinders, DOHC |
| Fuel | Regular nonleaded gasoline | Regular nonleaded gasoline |
| Engine speed | 6400 r.p.m. | 6000 r.p.m. |
| Material of intake valve | SUH 11 (JIS) | SUH 11 (JIS) |
| Material of exhaust valve | SUH 36 (JIS) | SUH 36 (JIS) |
| Exhaust gas temp. at exhaust manifold gathering section | 932° C. | 918° C. |
| Test time | 0.5 hr. | 100 hr. |

After completion of the durability test, an abrasion amount (depth of a worn portion) of the valve face portion (in the valve head) and the valve seat portion was measured for both the intake and exhaust valve sides by a three-dimensional surface roughness tester.

The results of the actual engine durability test and the temperature measurement test were shown together with the above result of the material confirmation test, in Tables 5 to 7.

As apparent from the results shown in Table 5, concerning the copper alloys of Examples 1 to 10 according to the present invention, the abrasion amount is slightly large in Examples 1 to 3 which is less in content of the intermetallic compounds; however, there is no possibility of bringing about failure in seal between the valve face portions and the valve seat portion. In other examples 4 to 10, the abrasion amount of the valve face portion and the valve seat portion is less thereby maintaining a good frictional surface at the valve face portions and valve seat portion.

In contrast, concerning the copper alloys according to Comparative Examples 1 to 15 which are not within the scope of the present invention, remarkable abrasion trace is formed particularly at the valve seat portion, so that there is the high possibility of bringing about engine trouble and degrading engine durability.

TABLE 5

| | | Characteristics of material (copper alloy) | | | Result of abrasion durability evaluation | | | | |
|---|---|---|---|---|---|---|---|---|---|
| | | | | | Abrasion amount on intake side | | Abrasion amount on exhaust side | | |
| Item Example | Main component(s) of intermetallic compounds | Volume percentage of precipitated intermetallic compounds (%) | High temperature hardness at 500° C. (Hv) | Measured temp. of exhaust valve (° C.) | Valve seat portion (μm) | Valve face portion (μm) | Valve seat portion (μm) | Valve face portion (μm) | Abrasion condition of padded valve seat portion |
| 1 | Al—V—Si | 15 | 220 | 715 | 63 | 11 | 47 | 5 | Abrasive wear, surface roughed |
| 2 | Al—V—Si, Cu—V—Si | 21 | 215 | 718 | 60 | 9 | 51 | 6 | Ditto |
| 3 | Al—V—Si, Cu—V—Si | 25 | 233 | 724 | 58 | 9 | 41 | 5 | Ditto |
| 4 | Al—V—Nb—Si, Cu—V—Nb—Si | 30 | 248 | 735 | 31 | 5 | 38 | 4 | Normal |
| 5 | Al—V—Ta—Co—Si, | 33 | 255 | 739 | 28 | 8 | 33 | 2 | Ditto |

TABLE 5-continued

| Item Example | Main component(s) of intermetallic compounds | Characteristics of material (copper alloy): Volume percentage of precipitated intermetallic compounds (%) | High temperature hardness at 500° C. (Hv) | Measured temp. of exhaust valve (° C.) | Result of abrasion durability evaluation: Abrasion amount on intake side: Valve seat portion (μm) | Abrasion amount on intake side: Valve face portion (μm) | Abrasion amount on exhaust side: Valve seat portion (μm) | Abrasion amount on exhaust side: Valve face portion (μm) | Abrasion condition of padded valve seat portion |
|---|---|---|---|---|---|---|---|---|---|
| | Cu—V—Ta—Co—Si | | | | | | | | |
| 6 | Al—Nb—Ta—Co—Si, Cu—Nb—Ta—Co—Si | 35 | 260 | 744 | 22 | 8 | 31 | 2 | Ditto |
| 7 | Al—V—Nb—Co—Fe—Si, Cu—V—Nb—Co—Fe—Si | 37 | 263 | 749 | 18 | 9 | 29 | 1 | Ditto |
| 8 | Al—V—Nb—Co—Fe—Ni—Si, Cu—V—Nb—Co—Fe—Ni—Si | 42 | 288 | 752 | 8 | 7 | 25 | 1 | Ditto |
| 9 | Al—V—Nb—Co—Fe—Ni—Si, Cu—V—Nb—Co—Fe—Ni—Mn—Si | 44 | 291 | 755 | 7 | 8 | 28 | 1 | Ditto |
| 10 | Al—V—Nb—Co—Fe—Ni—Si, Cu—V—Nb—Co—Fe—Ni—Mn—Si | 45 | 295 | 758 | 5 | 7 | 33 | 1 | Ditto |

TABLE 6

| Item Comparative Example | Main component(s) of intermetallic compounds | Characteristics of material (copper alloy): Volume percentage of precipitated intermetallic compounds (%) | High temperature hardness at 500° C. (Hv) | Measured temp. of exhaust valve (° C.) | Result of abrasion durability evaluation: Abrasion amount on intake side: Valve seat portion (μm) | Abrasion amount on intake side: Valve face portion (μm) | Abrasion amount on exhaust side: Valve seat portion (μm) | Abrasion amount on exhaust side: Valve face portion (μm) | Abrasion condition of padded valve seat portion |
|---|---|---|---|---|---|---|---|---|---|
| 1 | Al—V—Si | 10 | 143 | 714 | 86 | 12 | 89 | 18 | Abrasion with groove-like steps |
| 2 | Al—V—Si | 3 | 196 | 710 | 121 | 25 | 86 | 13 | Abrasion with groove-like steps |
| 3 | Al—V—Si, Cu—V—Si | 11 | 133 | 708 | 82 | 18 | 137 | 25 | Abrasion with groove-like steps |
| 4 | Al—V—Si, Cu—V—Si | 19 | 126 | 717 | 47 | 6 | 145 | 36 | Abrasion with groove-like steps only at exhaust side |
| 5 | Al—V—Nb—Si, Cu—V—Nb—Si | 34 | 241 | 732 | 88 | 56 | 65 | 43 | Pits formed at valve seat |
| 6 | Al—V—Nb—Si, Cu—V—Nb—Si | 33 | 251 | 740 | 91 | 37 | 83 | 31 | Valve seat chipped |
| 7 | Al—V—Nb—Co—Si, Cu—V—Nb—Co—Si | 28 | 245 | 737 | 36 | 7 | 37 | 4 | Normal |
| 8 | Al—V—Nb—Co—Si, Cu—V—Nb—Co—Si | 42 | 273 | 795 | 18 | 8 | 72 | 8 | Fusion-like state occurred only at exhaust side |
| 9 | Al—V—Nb—Co—Fe—Si, Cu—V—Nb—Co—Fe—Si | 34 | 267 | 745 | 24 | 8 | 33 | 3 | Normal |
| 10 | Al—V—Nb—Co—Fe—Ni—Si, Cu—V—Nb—Co—Fe—Ni—Si | 39 | 280 | 805 | 17 | 7 | 86 | 12 | Fusion-like state occurred only at exhaust side |

TABLE 7

| | | Characteristics of material (copper alloy) | | | | | | | |
|---|---|---|---|---|---|---|---|---|---|
| | | | | | Result of abrasion durability evaluation | | | | |
| | | | | | Abrasion amount on intake side | | Abrasion amount on exhaust side | | |
| Item Comparative Example | Main component(s) of intermetallic compounds | Volume percentage of precipitated intermetallic compounds (%) | High temperature hardness at 500° C. (Hv) | Measured temp. of exhaust valve (° C.) | Valve seat portion (μm) | Valve face portion (μm) | Valve seat portion (μm) | Valve face portion (μm) | Abrasion condition of padded valve seat portion |
| 11 | Al—V—Nb—Co—Fe—Ni—Si, Cu—V—Nb—Co—Fe—Ni—Mn—Si | 40 | 287 | 751 | 11 | 10 | 29 | 2 | Normal |
| 12 | Al—V—Nb—Co—Fe—Ni—Si, Cu—V—Nb—Co—Fe—Ni—Mn—Si | 43 | 290 | 811 | 9 | 6 | 95 | 22 | Fusion-like state occurred only at exhaust side |
| 13 | Cu—V—Nb—Co—Fe—Ni—Mn—Si | 28 | 128 | 743 | 35 | 9 | 136 | 39 | Abrasion with groove-like steps only at exhaust side |
| 14 | Al—Co—Fe—Ni—Si, Cu—Co—Fe—Ni—Mn—Si | 22 | 199 | 755 | 57 | 7 | 65 | 8 | Abrasion with groove-like steps |
| 15 | Al—V—Nb—Fe—Ni—Co, Cu—V—Nb—Fe—Ni—Co | 33 | 131 | 748 | 28 | 11 | 97 | 19 | Ditto |

Hereinafter, problems encountered in each of the copper alloys of Comparative Examples will be discussed.

Comparative Example 1:

The content of Al is as low as 0.4% by weight and therefore the copper alloy is low in hardness at room temperature. Additionally, the copper alloy is low in hardness at 500° C. though softening does not seem to occur at high temperatures. Such a low hardness also results from a little precipitation amount of the intermetallic compound Al—V—Si. As a result, the abrasion amount is large at the intake valve side valve seat portion which is predominant in abrasive wear due to deposits or the like. The abrasion amount is also large at exhaust valve side valve seat portion subjected to high temperatures, because formation of $Al_2O_3$ film is insufficient so as to cause oxidation of the valve seat portion.

Comparative Example 2:

The content of V in the group Va elements is as low as 0.03% by weight, and therefore the precipitation amount of the intermetallic compound Al—V—Si is remarkably small. As a result, although the hardness of the material matrix itself becomes high, the copper alloy is insufficient in abrasion resistance so that significant abrasion occurs both at the intake side valve seat and at the exhaust side valve seat.

Comparative Example 3:

The content of Si is as low as 0.3% by weight, and therefore this composition system (copper alloy) less in Al content is low in hardness level within a temperature range from room temperature to 500° C. while the precipitation amount of the intermetallic compounds is small. As a result, abrasion is severe at the intake side valve seat portion and more severe at the exhaust side valve seat portion.

Comparative Example 4:

The content of Al exceeds 5.0% by weight, and therefore the copper alloy is degraded in resistance to softening at high temperatures so as to be remarkably low in high temperature hardness at 500° C. As a result, although the abrasion at the intake side valve seat portion is less, remarkable abrasion with steps are formed at the exhaust side valve seat portion.

Comparative Example 5:

In this composition system (copper alloy) containing V and Nb in the group Va elements in an amount exceeding 5% by weight, lump of Fe—V and Fe—Nb used in dissolving law materials cannot be completely dissolved and segregated to remain in atomized powder thereby forming bulky hard particles. As a result, during the engine durability test, cracks are formed in the bulky hard particles, and therefore pits are formed at places of the surface of the valve seat portion while severe abrasion is made both at the valve face portion and the valve seat portion by the hard matters removed from the bulky hard particles.

Comparative Example 6:

In this composition system (copper alloy) containing Si in an amount exceeding 5% by weight, although a large amount of intermetallic compounds are precipitated, the material itself becomes brittle and therefore the valve seat portion is chipped, in which the chipped hard phase matters are brought into between the valve face portion and the valve seat portion. As a result, both the valve face and seat portions are severely worn.

Comparative Example 7:

In this composition system (copper alloy) prepared by adding 4.1% by weight of Co into a composition system (copper alloy) within the scope of the present invention, the abrasion condition at both the valve seat portion and the valve face portion is good or normal; however, the effect of addition of Co is difficult to be recognized. In this connection, the effect of addition of Co can be apparently recognized in Example 5 whose copper alloy contains Co in an amount not less than 5%, and therefore it is preferable to add Co in an amount not less than 5% by weight relative to the copper alloy.

Comparative Example 8:

In this composition system (copper alloy) containing Co in an amount exceeding 20% by weight, the precipitation amount of intermetallic compounds largely increases so that excellent abrasion resistance is exhibited at the intake side valve seat portion, while temperature of the exhaust valve abruptly increases as the thermal conductivity of the material (copper alloy) is degraded so that the exhaust side valve seat portion takes a fusion-like abrasion state while increasing the amount of the abrasion. Accordingly, the content of Co is preferably not more than 20% by weight relative to the copper alloy.

Comparative Example 9:

In this component system (copper alloy) obtained by adding 3.9% by weight of Fe into a component system (copper alloy) within the scope of the present invention, the abrasion condition at both the valve seat portion and the valve face portion is good or normal; however, the advantageous effect of addition of Fe is difficult to be recognized. As apparent from Example 7 of the present invention exhibiting a remarkable advantageous effect, the content of Fe is preferably not less than 5% by weight relative to the copper alloy.

Comparative Example 10:

Ni exhibits an abrasion resistance improving effect like Fe. In this composition system (copper alloy) containing Fe and Ni in total amount exceeding 20% by weight, a fusion-like abrasion state occurs at the exhaust side valve seat portion for the same reasons as those in Comparative Example 8. Accordingly, the total content of Fe and Ni is preferably not more than 20% by weight relative to the copper alloy.

Comparative Examples 11 and 12:

These component systems (copper alloys) demonstrate that the content of Mn is preferably limited within a range of from 1.0 to 10.0% by weight relative to the copper alloy, with reference to Example 9 of the present invention exhibiting an advantageous effect of addition of Mn similarly to Co, Fe and Ni.

Comparative Example 13:

In this component system (copper alloy), no Al is added relative to Example 9 of the present invention, and therefore the hardness of the matrix within a temperature range of from room temperature to 500° C. is remarkably lowered while the precipitation amount of the intermetallic compounds is reduced. As a result, the abrasion at the exhaust side valve seat portion is remarkably increased.

Comparative Example 14:

Since this component system (copper alloy) contains no elements of the group Va relative to Example 9 of the present invention, the precipitation amount of the intermetallic compounds is remarkably decreased. As a result, the abrasion amount at both the intake and exhaust side valve seat portions is increased.

Figure 2:
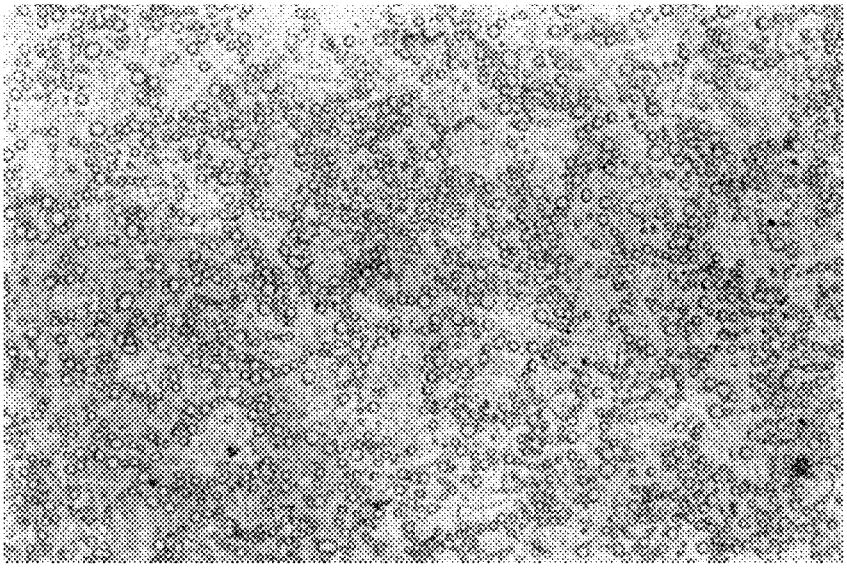
FIG. 2 is a microphotograph of the texture of the copper alloy of Comparative Example 15 which is not within the scope of the present invention.

Comparative Example 15:

Since this component system (copper alloy) contains no Si relative to Example 8 of the present invention, the matrix hardness within the temperature range of from room temperature to 500° C. is remarkably lowered while the precipitation amount of the intermetallic compounds is decreased in which particularly bulky precipitate is disappeared. In this regard, FIGS. 1 and 2 show respectively dispersed states of precipitate in the copper alloys of Example 8 and Comparative Example 15, in which generally circular portions correspond to generally spherical or granular intermetallic compounds.

As a result, with this composition system, abrasion at the exhaust side valve seat portion is considerably increased. In contrast, in the composition system of Example 8 of the present invention, bulky spherical or granular precipitates having a grain size exceeding 10 $\mu$m as shown in FIG. 1 exist, and therefore it is recognized that the abrasion resistance is improved even at the exhaust side valve seat portion subjected to severe abrasive wear, as compared with the composition system of Comparative Example 15 having the microstructure of FIG. 2 where no bulky precipitate exists.

As discussed above, each copper alloy of Examples of the present invention exhibits not only an excellent abrasion resistance at high temperatures, required for an exhaust side valve seat of a high performance engine, but also an excellent abrasion resistance required for an intake side valve seat to be subjected to severe abrasive wear due to the fact that deposit or the like is brought into between the intake valve and valve seat.

While the copper alloy of the present invention has been described as being padded or clad on the valve face portion and/or valve seat portion of the engine by means of laser, it will be understood that a valve seat ring may be formed of the copper alloy of the present invention under casting or sintering to be press-fitted to a cylinder head, or otherwise a valve guide may be formed of the copper alloy of the present invention. Additionally, it will be appreciated that the copper alloy of the present invention may be employed as the material of sliding members or the like of an engine which require performance similar to the intake and exhaust valves, the valve seat and the valve guide. Thus, the copper alloy of the present invention can be widely usable for the materials of a variety of machinery parts and elements.

What is claimed is:

1. A high temperature abrasion resistant copper alloy consisting essentially of:

aluminum in an amount ranging from 1.0 to 5.0% by weight;

at least one of vanadium, niobium and tantalum, in an amount ranging from 0.1 to 5.0% by weight;

silicon ranging from 1.0 to 5.0% by weight;

at least one of cobalt, nickel or iron employed in an amount ranging from 5.0 to 20.0% by weight, or manganese employed in an amount ranging from 1.0 to 10.0% by weight;

and balance consisting essentially of copper and impurities;

said copper alloy having a texture in which at least one kind of intermetallic compounds is dispersed in an amount not less than 15 % by volume, said at least one kind of intermetallic compounds comprising aluminum, at least one selected from the group consisting of elements in the group Va of the periodic table, and silicon.

2. A high temperature abrasion resistant copper alloy as claimed in claim 1, wherein said intermetallic compounds have a grain size not smaller than 5 micrometers.

3. A high temperature abrasion resistant copper alloy as claimed in claim 1, wherein when said copper alloy is employed as a valve seat in an engine cylinder and subjected to an abrasion durability evaluation, the abrasion on an intake side of a valve seat portion of said valve seat is less than 63 micrometers, the abrasion on an intake side of a valve face portion of said valve seat is less than 11 micrometers, an abrasion amount on an exhaust side of said valve seat portion is less than 47 micrometers, and an abrasion amount on an exhaust side of said valve face portion is less than 6 micrometers.

* * * * *